US010826211B2

(12) United States Patent
Wang et al.

(10) Patent No.: US 10,826,211 B2
(45) Date of Patent: Nov. 3, 2020

(54) CONNECTOR CONTACT WITH DUAL CONTACT BEAMS DERIVED FROM DIFFERENT CONTACT STRIPS

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Xin-Wei Wang, Huaian (CN); Guo-Xiang Niu, Huaian (CN); Zhuang Chen, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/258,681

(22) Filed: Jan. 28, 2019

(65) Prior Publication Data

US 2019/0237884 A1 Aug. 1, 2019

(30) Foreign Application Priority Data

Feb. 1, 2018 (CN) ..... 2018 1 0101632

(51) Int. Cl.
*H01R 12/72* (2011.01)
*H01R 13/11* (2006.01)
(Continued)

(52) U.S. Cl.
CPC ..... *H01R 12/721* (2013.01); *H01R 13/11* (2013.01); *H01R 13/15* (2013.01);
(Continued)

(58) Field of Classification Search
CPC .... H01R 13/2457; H01R 13/15; H01R 13/11; H01R 13/2492; H01R 43/16; H01R 12/16; H01R 13/721
See application file for complete search history.

(56) References Cited

U.S. PATENT DOCUMENTS 3,631,381 A * 12/1971 Pittman ..... H01R 12/721 439/637
5,162,002 A * 11/1992 Regnier ..... H01R 12/721 439/157

(Continued)

FOREIGN PATENT DOCUMENTS

CN 103904450 A 7/2014

*Primary Examiner* — Briggitte R. Hammond
(74) *Attorney, Agent, or Firm* — Wei Te Chung; Ming Chieh Chang

(57) ABSTRACT

A card edge connector with an insulative housing includes opposite longitudinal side walls along a longitudinal direction with a receiving slot therebetween in a transverse direction. Each side wall forms a plurality of passageways. A plurality of contacts are respectively received within the corresponding passageways. Each contact includes a retaining section, a contacting section extending from the retaining section into the receiving slot, and a leg extending downwardly from the retaining section out of the housing. Each contact is further equipped with an auxiliary spring beam with an additional contacting section extending into the receiving slot. The contacts are initially linked to a single contact carrier strip so as to be simultaneously inserted into the corresponding passageways, respectively.

20 Claims, 7 Drawing Sheets

(51) Int. Cl.

| | |
|---|---|
| ***H01R 13/15*** | (2006.01) |
| ***H01R 43/16*** | (2006.01) |
| ***H01R 13/24*** | (2006.01) |
| ***H01R 12/71*** | (2011.01) |

(52) U.S. Cl.
CPC ..... *H01R 13/2492* (2013.01); *H01R 43/16* (2013.01); *H01R 12/716* (2013.01)

(56) References Cited

U.S. PATENT DOCUMENTS

| | | | | |
|---|---|---|---|---|
| 7,637,783 | B2 * | 12/2009 | Sasaoka | H01R 43/16 439/637 |
| 8,550,855 | B2 * | 10/2013 | Zhang | H01R 13/6477 439/636 |
| 8,672,713 | B2 * | 3/2014 | Tajiri | H01R 12/585 439/630 |
| 9,608,349 | B2 * | 3/2017 | Mashiyama | H01R 12/716 |
| 2002/0022381 | A1 * | 2/2002 | Ito | H01R 12/721 439/60 |

* cited by examiner

CONNECTOR CONTACT WITH DUAL CONTACT BEAMS DERIVED FROM DIFFERENT CONTACT STRIPS

BACKGROUND OF THE INVENTION

1. Field of the Invention

The present invention relates generally to an electrical connector, and more particularly to the contact for use within the card edge connector to be equipped with dual contact beams derived from different contact strips.

2. Description of Related Arts

Recently, two contacting points of each contact in the connector for assuring reliable connection is desired. U.S. Pat. No. 9,966,679 discloses a contact used within a card edge connector having dual spring beams derived from a stamping/blanking process. Notably, such blanking type contacts cannot be densely arranged along a contact carrier strip for simultaneously assembling the contacts into the corresponding passageways via one push operation. China Patent No. 103904450 disclose a forming type contact with dual spring beams in a signal contact. Anyhow, because the contact may take more material for forming the auxiliary/second spring beam, it is also impossible to have all the contacts densely arranged on a contact carrier strip for one time insertion into the corresponding passageways for assembling, thus complicating the manufacturing procedure.

An electrical connector is desired to have a plurality of contacts each having two spring beams with two contacting points thereof while all contacts are able to be densely arranged contacts on the contact carrier strip for one time insertion into the corresponding passageways of the electrical connector.

SUMMARY OF THE INVENTION

An object of the present invention is to provide a card edge connector with an insulative housing having opposite longitudinal side walls along a longitudinal direction with a receiving slot therebetween in a transverse direction. Each side wall forms a plurality of passageways. A plurality of contacts are respectively received within the corresponding passageways. Each contact includes a retaining section, a contacting section extending from the retaining section into the receiving slot, and a leg extending downwardly from the retaining section out of the housing. Each contact is further equipped with an auxiliary spring beam with an additional contacting section extending into the receiving slot. The contacts are initially linked to a single contact carrier strip so as to be simultaneously inserted into the corresponding passageways, respectively.

Optimally, the auxiliary spring beam is pre-assembled upon the corresponding contact before the contact is inserted into the corresponding passageway via the common contact carrier strip.

DETAILED DESCRIPTION OF THE PREFERRED EMBODIMENT

Figure 1:
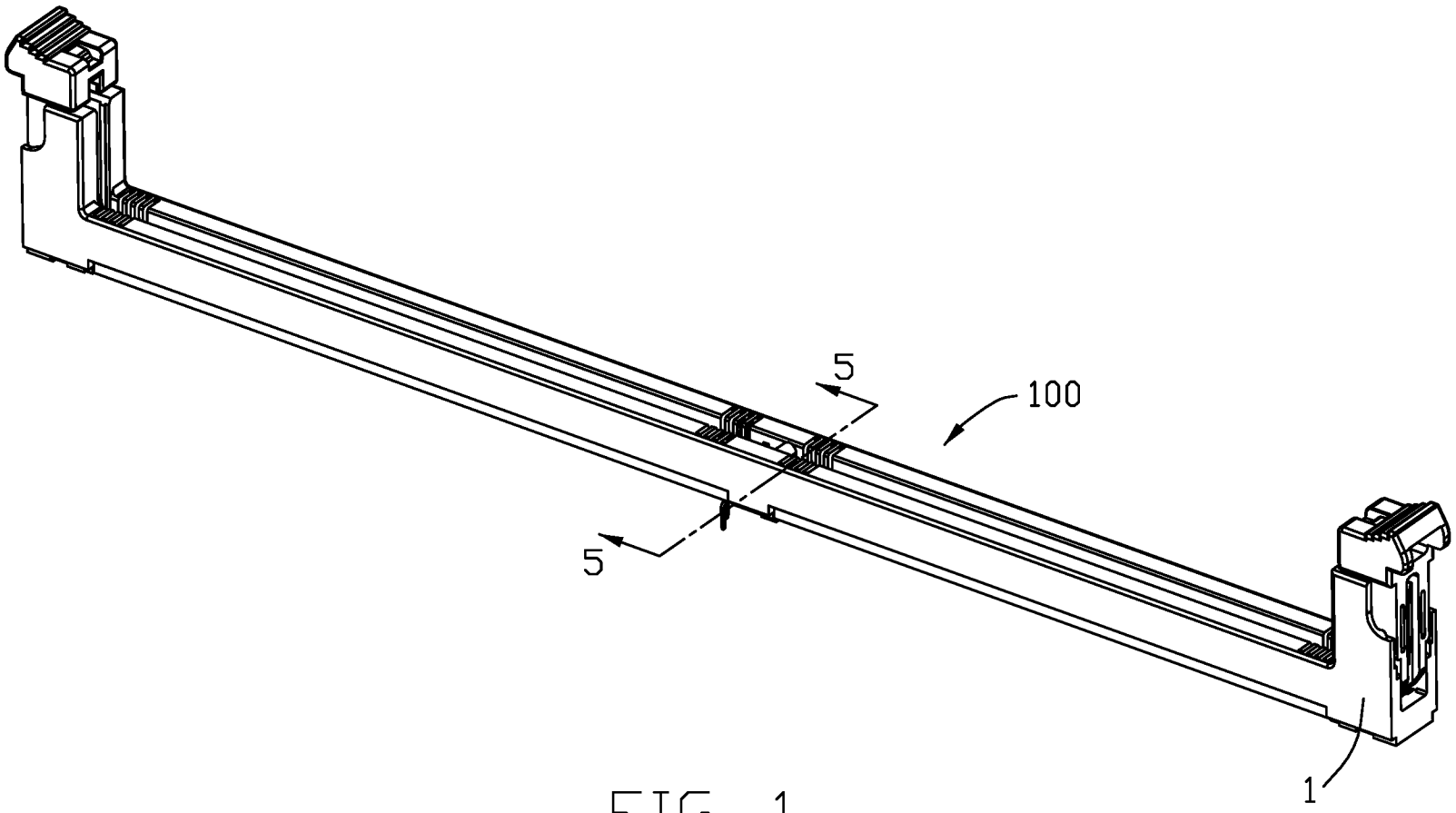
FIG. 1 is a perspective view of a card edge connector according to the invention.
Figure 2:
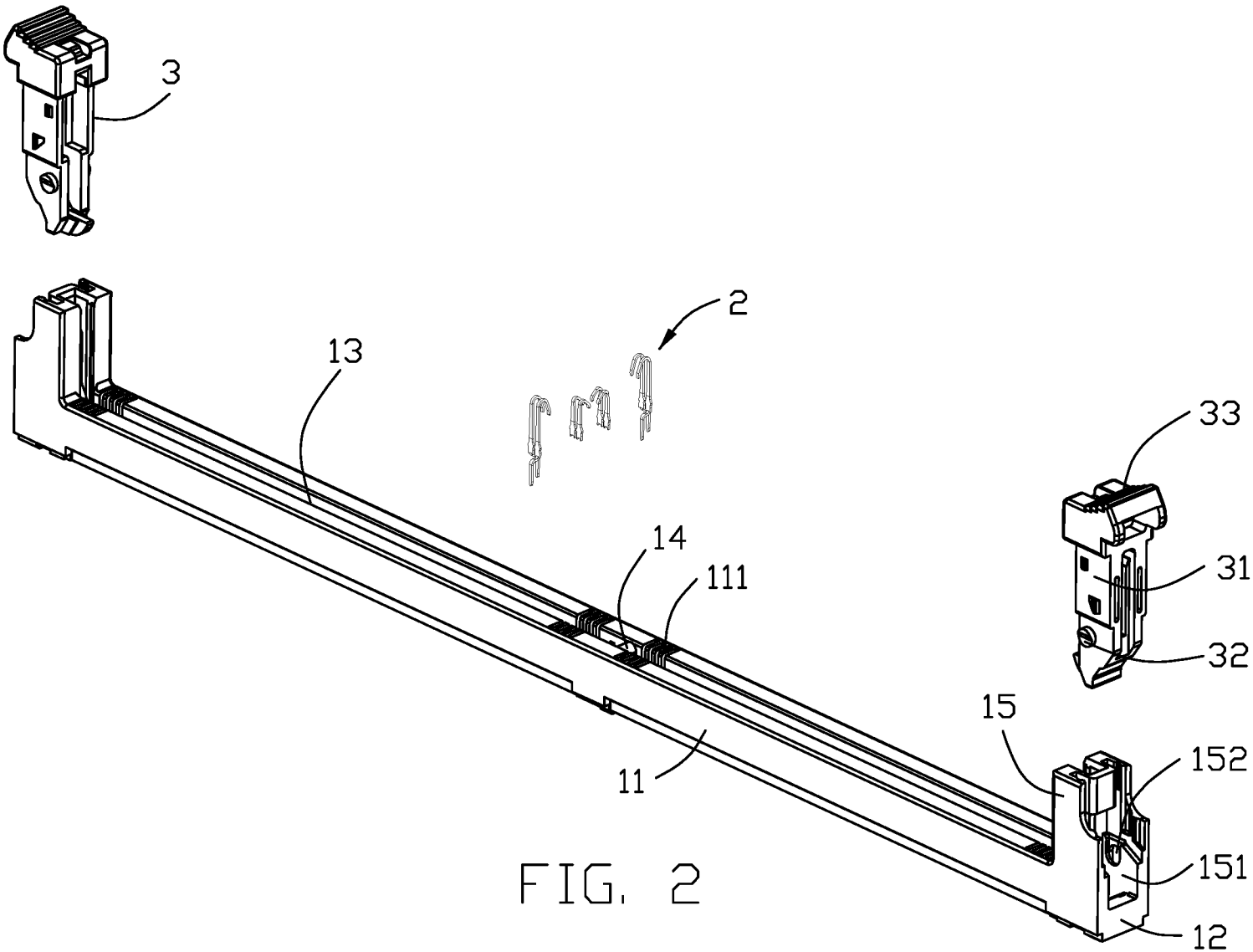
FIG. 2 is an exploded perspective view of the electrical connector of FIG. 1.
Figure 3:
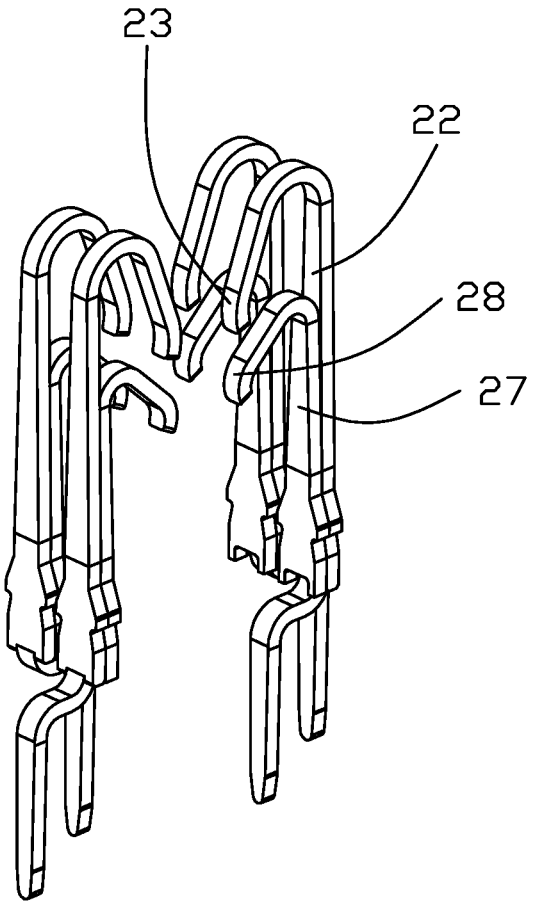
FIG. 3 is a perspective view of a pair of opposite contacts used within the electrical connector of FIG. 1 wherein the auxiliary spring beam is attached thereon.
Figure 4:
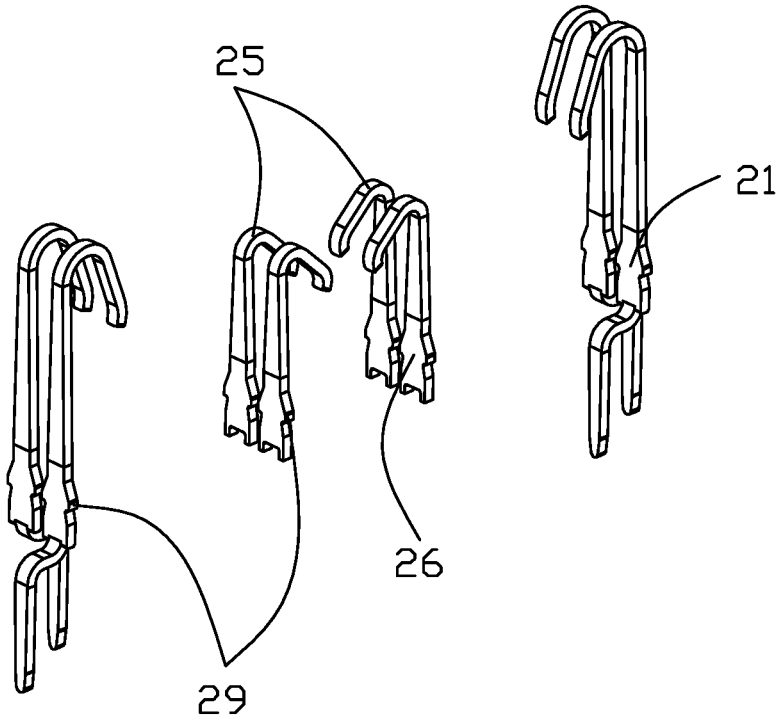
FIG. 4 is an exploded perspective view of the pair of opposite contacts used within the electrical connector of FIG. 3.
Figure 5:
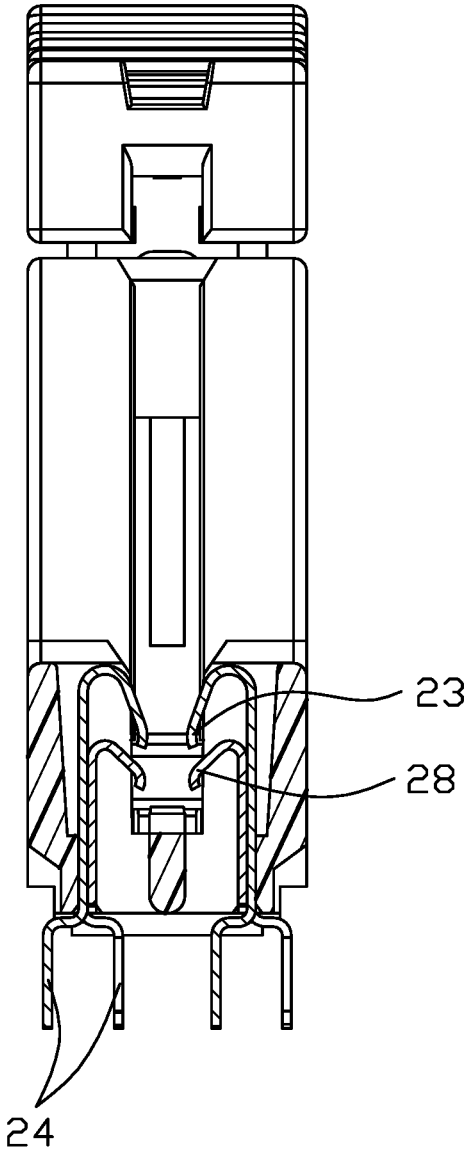
FIG. 5 is a cross-sectional view of the electrical connector of FIG. 1 to show the pair of opposite contacts of FIG. 3.

Referring to FIG. 1-7, a card edge connector 100 for receiving a memory module (not shown) therein for mounting to a printed circuit board (not shown), includes an insulative elongated housing 1, a plurality of contacts 2 retained therein, and a pair of rotatable ejectors 3 at two opposite longitudinal ends.

The housing 1 includes a pair of longitudinal side walls 11 and a pair of end walls 12 to commonly form a receiving slot 13. A plurality of (contact-receiving) passageways 111 are formed in each side wall 11 to communicate with the receiving slot 13. The contacts 2 are received within the corresponding passageways 111. A key 14 is formed in the receiving slot 13 to be received within a corresponding notch in the bottom edge of the memory module during mating for assuring the correct orientation of the memory module within the receiving slot 13. A pair of towers 15 are located on two opposite end walls 12. Each tower 15 forms a cavity 151 and a pivot hole 152. The ejector 3 includes a main body 31 received within the cavity 151, a pivot 32 received within the pivot hole 152, and a handle 33 at the top.

The contact 2 includes a retaining section 21 fixed within the passageway 111, an extension 22 extending upwardly from the retaining section 21, a resilient contacting section 23 extending from the extension 22 and into the receiving slot 13, and a tail section 34 extending from a bottom end of the retaining section 21 and out of the housing 1. The adjacent two contacts 2 have opposite extending tail sections 24 in a transverse direction.

Each contact 2 is further equipped with an auxiliary spring beam 25 attached upon an interior face thereof. The auxiliary spring beam 25 includes an auxiliary retaining section 26 attached to the retaining section 21, an auxiliary extension 27 upwardly extending from the auxiliary retaining section 26, and an auxiliary contacting section 28 extending from the auxiliary extension 27 and into the receiving slot 13. The securement between the retaining section 21 and the auxiliary retaining section 26 may be made by soldering, welding or riveting, etc., so as to form a one piece arrangement thereof. The auxiliary extension 27 abuts against an inner surface of the extension 22 with a less length compared to the extension 22 so as to have the auxiliary contacting section 28 is lower than the contacting section 23. Because both the contacting section 23 and the auxiliary contacting section 28 commonly contacts the same pad on the memory module, thus resulting in double contacting points for enhancing the reliability of the electrical connection between the contact and the corresponding pad. Notably, the auxiliary spring beam 25 lacks the tail section for not affecting the original layout of the printed circuit board. In this embodiment, both the retaining section 21 and the auxiliary retaining section 26 have the corresponding barbs 29 for retention. Anyhow, in an alternate embodiment the barbs of the auxiliary retaining section 26 may be omitted.

According to the invention, the contacts 2 still can be densely arranged with a single contact carrier strip (not shown) in compliance with the fine pitch defined by the passageways along the longitudinal direction and such contact carrier strip should be removed after assembling. In opposite, in the aforementioned China patent No. 103904450, each contact may cost two pitches material for both the original contact and the auxiliary spring arm, thus failing to use a single contact carrier strip for assembling all contacts in one time. Instead, it requires one contact carrier strip for the odd number contacts and another contact carrier strip for the even number contacts disadvantageously.

Figure 6:
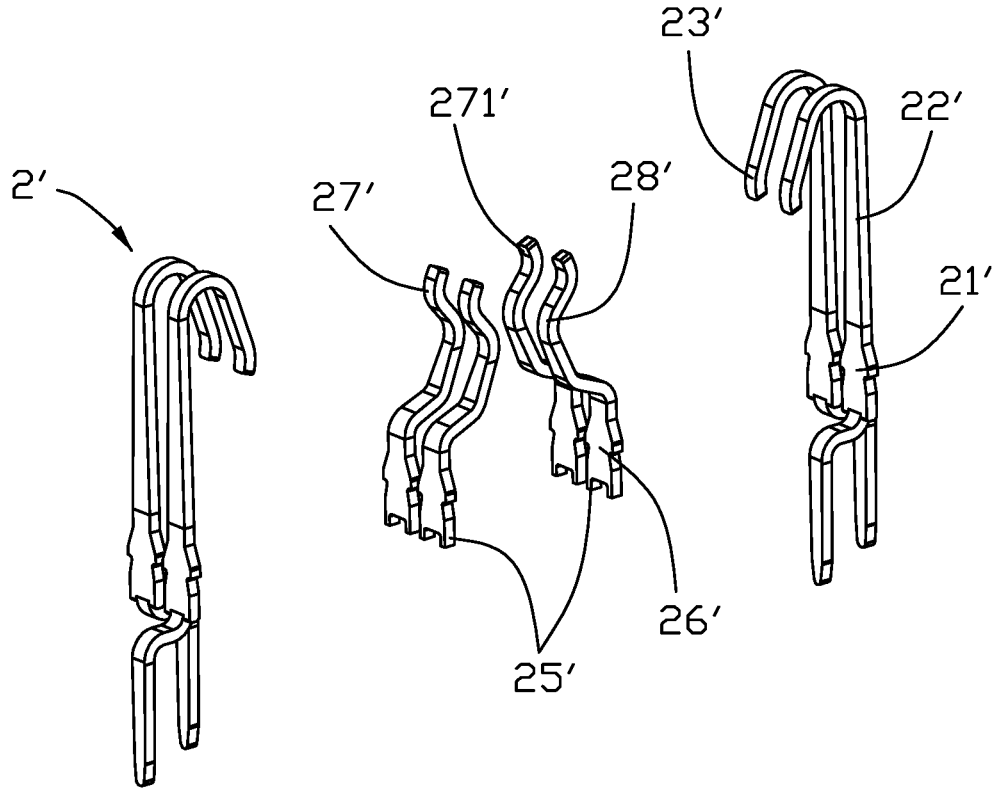
FIG. 6 is an exploded perspective view of a pair of opposite contacts for use with the electrical connector according to a second embodiment.
Figure 7:
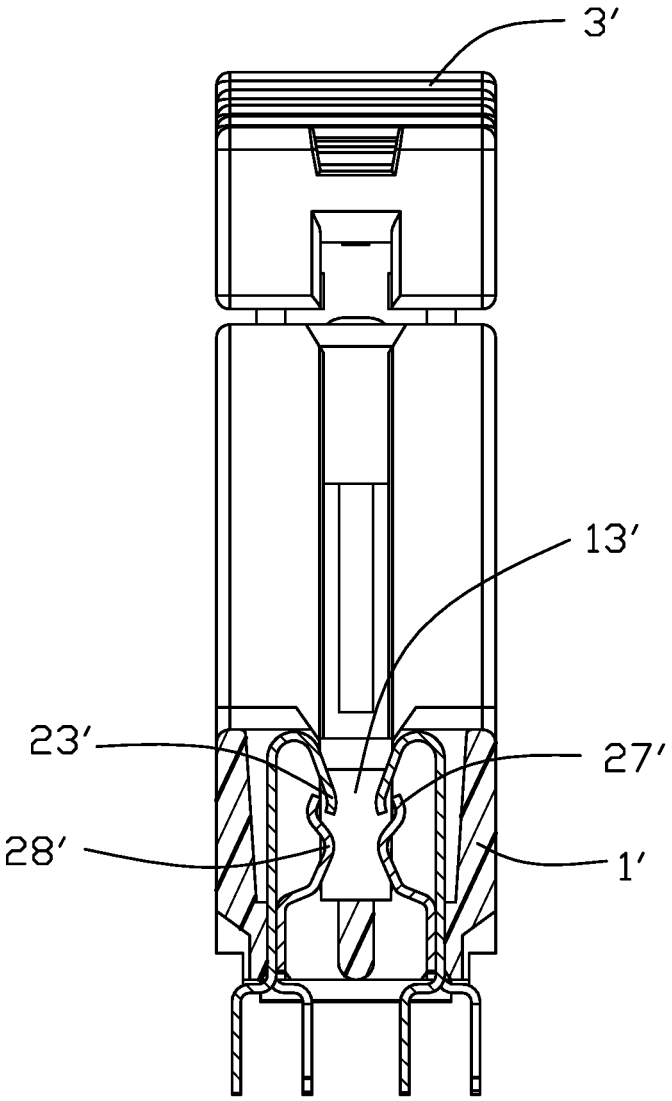
FIG. 7 is a cross-sectional view of the electrical connector according to the second embodiment of FIG. 6.

FIGS. 6 and 7 shown a second embodiment having an electrical connector 100' similar to the connector 100 in the first embodiment except that the contact 2' with the associated auxiliary spring beam has the different structures compared with the contact 2 in the first embodiment.

The contact 2' itself being essentially same with the contact 2, includes a retaining section 21', an extension 22' extending upwardly from the retaining section 21', a contacting section 23' extending downwardly from the extension 22' and into the receiving slot 13', and a tail section 24' extending from the retaining section 21' downwardly outside of the housing 1'. The tail sections 24' of the neighboring contacts extend in opposite transverse directions.

The corresponding auxiliary spring beam 25' includes a retaining section 26' attached upon the retaining section 21', an auxiliary contacting section 28' extending upwardly from the auxiliary retaining section 26' and firstly into the receiving slot 13' and finally away from the receiving slot 13', and an extension 27' extending upwardly from a top end of the auxiliary contacting section 28' with a tip 271 intimately located behind the contacting section 23'.

Similar to the connector 100 in the first embodiment, the contact 25 with the associate auxiliary spring beam 25' of the connector 100' perform s two contacting points upon the corresponding pad on the memory module (not shown) received within the receiving slot 13'. When the contacting section 23' is deflected by the inserted memory module (not shown) outwardly and laterally along the transverse direction, the tip 271' may provide support for enhancing the electrical connection between the contacting section 23' and the corresponding pad of the memory module. In this situation, the auxiliary contacting section 28 may experience two-point deflection. Anyhow, the outward deflection due to engagement between the tip 271' and the contacting section 23' should not affect the desired normal force between the auxiliary contacting section 28' and the corresponding pad of the memory module during mating.

In brief, in the preferred embodiment, the auxiliary retaining section is optically secured to the retaining section before the contact is assembled into the corresponding passageway via the single contact carrier strip. Anyhow, when the tail section are arrange to extend outwardly and horizontally in a surface mount type, the auxiliary spring beam may be independently assembled into the corresponding passageway and abutting against the interior surface of the retaining section after the contact has been assemble into the corresponding passageway.

What is claimed is:

1. A card edge connector for use with a memory module, the card edge connector comprising;

an elongated housing including opposite side walls extending along a longitudinal direction with a receiving slot therebetween in a transverse direction perpendicular to the longitudinal direction to communicate with an exterior in a vertical direction perpendicular to both the longitudinal direction and the transverse direction for receiving the memory module therein;

a plurality of passageways formed in each of the side walls and communicating with the receiving slot; and a plurality of contacts disposed in the corresponding passageways, respectively, each of the contacts including a retaining section fixed to the housing, a contacting section above the retaining section and extending into the receiving slot, and a tail section below the retaining section and exposed outside of the housing; wherein each contact is equipped with an auxiliary spring beam which is discrete from the contact and a includes an auxiliary retaining section secured to the retaining section, and an auxiliary contacting section extending into the receiving slot and located below the contacting section in the vertical direction so as to form two contacting points of each contact with regard to a corresponding pad on the memory module; wherein the retaining section extends in a plane along the longitudinal direction with barbs at two sides.

2. The card edge connector as claimed in claim 1, wherein the auxiliary retaining section extends in another plane along the longitudinal direction and has barbs retained to the housing.

3. The card edge connector as claimed in claim 1, wherein both the contacting section and the auxiliary contacting section extend downwardly in the vertical direction.

4. The card edge connector as claimed in claim 1, wherein the contacting section extends downwardly while the auxiliary contacting section extends upwardly.

5. The card edge connector as claimed in claim 4, wherein an auxiliary extension extends upward from the auxiliary contacting section and located behind the contacting section in the transverse direction.

6. The card edge connector as claimed in claim 5, wherein the contacting section abuts against the auxiliary extension when the contacting section is outwardly and laterally deflected in the transverse direction by the memory module.

7. The card edge connector as claimed in claim 1, wherein each auxiliary spring beam lacks tail section exposed outside the housing.

8. A method of making a card edge connector comprising steps of:

forming an insulative elongated housing with two rows of passageways by two sides of a receiving slot in a transverse direction;

providing a plurality of contacts, each of the contacts including a retaining section and a contacting section above the retaining section;

providing a plurality of auxiliary spring beams discrete from the plurality of contacts;

securing the plurality of auxiliary spring beams upon the corresponding contacts, respectively, each of the auxiliary spring beams including an auxiliary contacting section below the corresponding contacting section in a vertical direction perpendicular to the transverse direction; and assembling all the plurality of contacts into the corresponding passageways, respectively.

9. The method as claimed in claim 8, wherein the contacting section is higher than the auxiliary contacting section in a vertical direction perpendicular to the transverse direction.

10. The method as claimed in claim 8, wherein the auxiliary spring beam is secured to the retaining section of the corresponding contact.

11. The method as claimed in claim 8, wherein each auxiliary spring beams has an auxiliary retaining section secured to the retaining section of the corresponding contact.

12. The method as claimed in claim 11, wherein auxiliary retaining section is secured to the housing additionally.

13. The method as claimed in claim 8, wherein both the contacting section and the auxiliary contacting section extend downwardly in the vertical direction.

14. The method as claimed in claim 8, wherein the contacting section extends downwardly while the auxiliary contacting section extends upward.

15. The method as claimed in claim 8, wherein the retaining section extends in a plane along the longitudinal direction with barbs on two sides.

16. An electrical connector comprising:

an insulative elongated housing including opposite side walls extending along a longitudinal direction with a receiving slot therebetween in a transverse direction perpendicular to the longitudinal direction to communicate with an exterior along a vertical direction perpendicular to both the longitudinal direction and the transverse direction;

a plurality of passageways formed in each of the side walls;

a plurality of contacts assembled into the corresponding passageways, respectively, each of the contacts including a retaining section fixed to the housing, a contacting section located above the retaining section and extending into the receiving slot, and a tail section exposed outside of the housing;

a plurality of auxiliary spring beams which are discrete from the plurality of contacts and assembled into the corresponding passageways and located inside of the corresponding contacts, respectively, to be closer to the receiving slot than the corresponding contacts; wherein each auxiliary spring beam includes an auxiliary contacting section extending into the receiving slot below the corresponding contacting section while lacking a corresponding tail section exposed outside of the housing.

17. The electrical connector as claimed in claim 16, wherein the retaining section of each contact extends in a plane along the longitudinal direction.

18. The electrical connector as claimed in claim 17, wherein each auxiliary spring beam is secured to the corresponding contact in the same passageway, so that the auxiliary spring beam is assembled into the corresponding passageway via assistance of the corresponding contact.

19. The electrical connector as claimed in claim 18, wherein the auxiliary spring beam is secured to the retaining section of the corresponding contact.

20. The electrical connector as claimed in claim 18, wherein the contacting section of each contact is supported by the corresponding auxiliary spring beam.

* * * * *